United States Patent [19]

Marlatt

[11] Patent Number: 4,934,335

[45] Date of Patent: Jun. 19, 1990

[54] POWER VENT

[76] Inventor: George R. Marlatt, 103 Almore Avenue, Downsview, Ontario, Canada, M3H 2H4

[21] Appl. No.: 302,520

[22] Filed: Jan. 27, 1989

[51] Int. Cl.[5] ..... F24C 3/00

[52] U.S. Cl. ..... 126/85 B; 98/42.5

[58] Field of Search ..... 126/85 B, 293, 312, 126/307 R, 80; 98/42.05, 48

[56] References Cited

U.S. PATENT DOCUMENTS

| | | | |
|---|---|---|---|
| 3,765,823 | 10/1973 | Kawabata et al. | 126/85 B |
| 4,262,608 | 4/1981 | Jackson | 126/85 B |
| 4,424,792 | 1/1984 | Shimek et al. | 126/80 |
| 4,712,515 | 12/1987 | Couprie | 98/48 |

*Primary Examiner*—Carroll B. Dority
*Attorney, Agent, or Firm*—Kenneth M. Garrett

[57] ABSTRACT

A power vent for a furnace or the like comprises an air inlet tube having axially opposed ends; one end has an air intake opening which will normally locate outdoors; the opposed end connects to the inlet of a blower, with the outlet of the blower connecting to a vent tube. The flue of the furnace connects to the air inlet tube intermediate the ends thereof. The vent tube may suitably locate coaxilly within the inlet tube. The system will normally be sized such that the ratio of fresh air to flue gas is from about 5:1 to about 50:1, and residence times between the flue entry to the air inlet tube and the blower outlet are low, of the order of 0.01 second, thereby reducing the incidence of condensation and icing in the power vent. The system may be balanced, for example by varying the area of the air intake opening, whereby negative pressures within the furnace are avoided, thereby increasing the efficiency of furnace operation.

28 Claims, 3 Drawing Sheets

POWER VENT

FIELD OF INVENTION

This invention relates to a vent for combustion appliances to eliminate the need for a chimney.

BACKGROUND OF INVENTION

It is well established that the exhaustion of combustion gases through a chimney using natural draft is energy wasteful. Moreover, it promotes a turbulent flow of gases, in the combustion appliance, with sooting and rapid, premature corrosion resulting therefrom.

Many proposals have heretofore been advanced for power vents. In accordance with certain proposals, a blower located indoors is used, and draft control is provided by permitting the entry of ambient room air to the blower. This is energy wasteful, and blower temperatures tend to be high, leading to rapid corrosion of the blower and motor failure.

In accordance with other proposals as exemplified U.S. Pat. Nos. 4,757,802 (GUZOREK) and 4,424,792 (SHIMEK et al), the blower unit locates outdoors, and outside air is used for draft control, tending to overcome the foregoing problems. However, there are other problems associated with these vent structures, particularly in cold, northern climates, due to condensation and icing in the blower unit and outlet thereto, and in the motor requiring an auxiliary heating circuit or other provisions to overcome bearing drag. Additionally, in one proposal, in order to provide a compact outdoor unit, the shaft of the blower unit is arranged in axial alignment with the vent tube, and the exhaust is downwardly directed, whereby problems of exhaust recirculating into the fresh air entry duct may be experienced. Moreover, installation and maintenance of a power vent wherein operative components are located outdoors is increased in comparison to where such components are located indoors.

It has recently been observed that buildings may have a pronounced thermal updraft associated therewith. Where a hooded, downwardly opening aperture is provided adjacent a building wall, the hood acts as a wind scoop, and a current of cold outside air may flow through a vent tube. Flat valves are well known, but may not be permitted for use in chimney vents by many building codes.

SUMMARY OF THE INVENTION

In accordance with this invention, a power vent includes a blower unit located indoors, and a first tube having an air intake opening at one end that will locate outdoors connects to the inlet of the blower unit. The outlet of the blower unit connects directly to a second tube having its discharge opening locating outdoors. The first tube is provided with a T connector intermediate the ends thereof, preferably adjacent the interior end, to which a furnace flue connects. The components will generally be such that the volume of outside air flowing through the vent will be several times that of the flue gas, generally in the ratio of between about 5:1 and 50:1, and preferably in the range 10:1 to 20:1. The flow rates within the power vent will be relatively high, typically at least 50 feet/second in domestic installation. Accordingly, temperatures in the power vent will be low, as will be residence times, particularly between the T connector and the outlet of the blower unit, whereby relatively little condensation of moisture in the blower unit will arise, and premature corrosion in this area, and in the power vent as a whole, will be minimized.

Since the blower unit locates indoors, problems connected with icing therein will not normally be encountered, and the cost of installation and maintenance will be reduced in comparison to externally located units.

Preferably the power vent will include a draft regulator, which may be pre-set to balance a vent system such that negative pressures in the combustion appliance are minimized, to thereby maximize the efficiency of combustion and heat exchange within the combustion appliance. Desirably the presettable control will be operable from inside the building, and accessible only to maintenance technicians.

Suitably the first and second tubes are arranged coaxially, with the blower outlet connecting to the inner tube and the blower inlet to the outer tube. Desirably the inner tube i.e. the vent tube, will have an unrestricted outlet orifice, and gas will be discharged in an axial direction therefrom,; the outer tube will desirably have an air intake opening in the peripheral wall thereof, whereby air will be drawn into the outer tube in directions at right angles to the flow of the discharged gases, thereby reducing the possibility of undesired recirculation of the of exhaust gases.

Preferably the air intake opening will extend about the whole of the periphery of the outer tube whereby updraft air adjacent an exterior building wall through which the power vent passes will not tend to be diverted along the air inlet tube into the building.

These foregoing objects and aspects of the invention, together with other objects, aspects and advantages thereof will be more apparent from the following description of a preferred embodiment thereof, taken in conjunction with the following drawings.

IN THE DRAWINGS

DESCRIPTION OF THE PREFERRED EMBODIMENT

Figure 1:
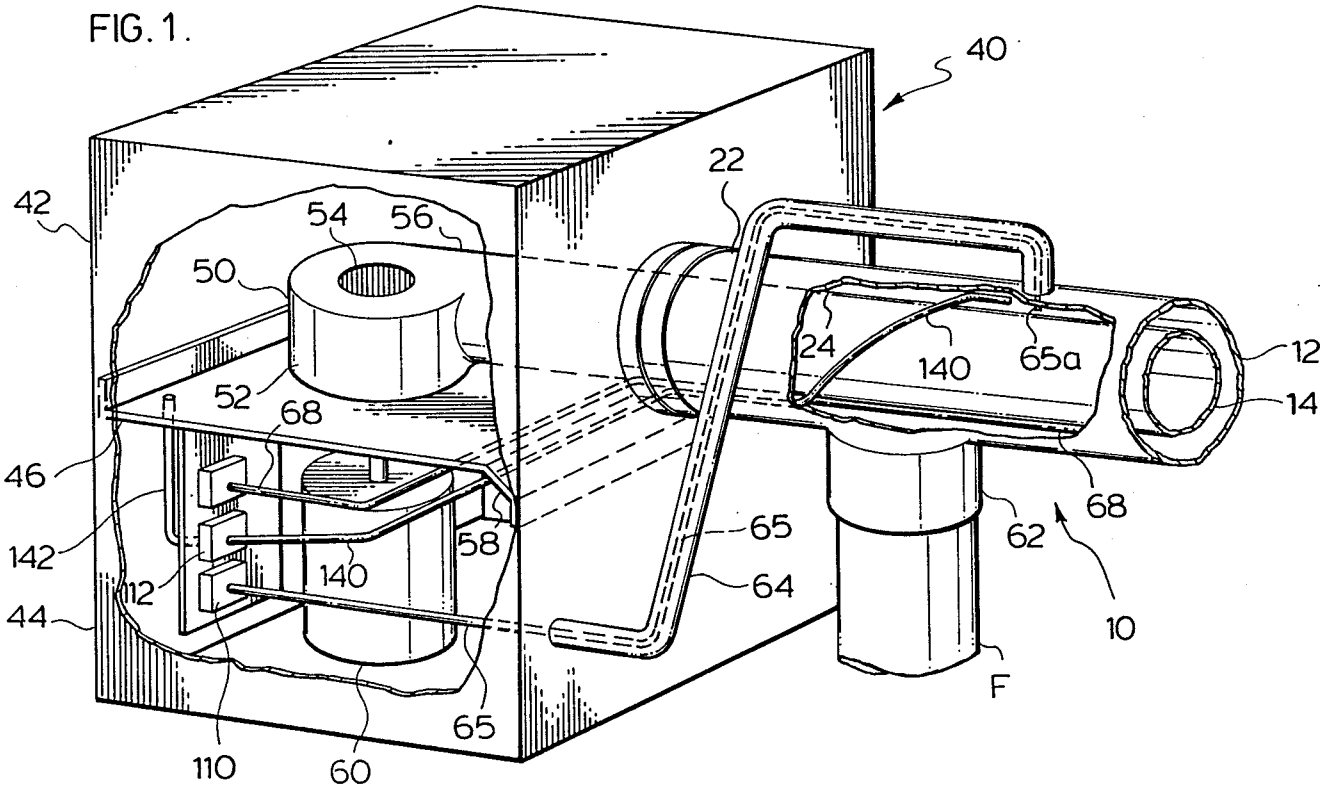
FIG. 1 shows the inner end of the power vent in perspective, broken away, schematic view to show hidden detail.
Figure 2:
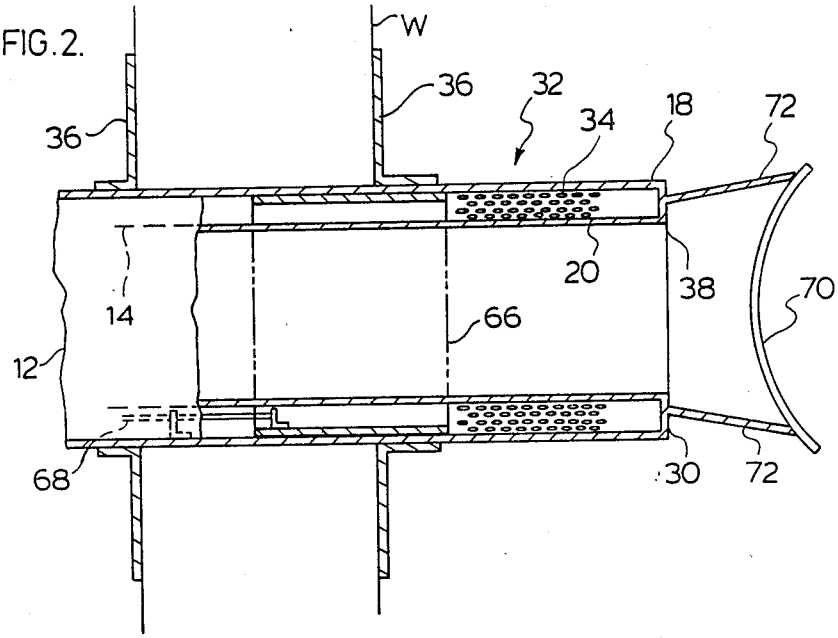
FIG. 2 shows the outer end of the power vent in elevational, part sectional and broken away to reveal interior detail.

In the drawings, like parts are identified throughout by the like reference numerals. Considering the drawings in detail, a power vent in accordance with the invention is identified generally by the numeral 10. Power vent 10 comprises an outer tube 12, otherwise referred to as inlet tube 12, and an inner tube 14, otherwise referred to as a vent tube 14, concentrically located within outer tube 12. Tubes 12 and 14 are generally axially coextensive, and each has a first, axially outer end respectively identified as 18, 20 and a second axially inner end respectively identified as 22, 24. Outer ends 18, 20 are sealed together by annular ring 30.

Outer end 18 is provided with an intake opening 32 formed by a plurality of perforations 34 arranged substantially about the whole of the periphery of outer tube 12. Collars 36 are provided to seal outer tube 12 to a wall W through which the power vent 10 passes, with intake opening 32 locating on the outside of the wall.

Outer end 20 of vent tube 14 has an unrestricted, full bore discharge orifice 38.

At the inner end of tubes 12, 14 there is provided a housing 40 comprising a blower compartment 42 and drive motor compartment 44, and an axially aligned containment fence 46 forming a common wall therebetween. A squirrel cage blower 50 having a scroll housing 52, an inlet 54 and an outlet 56 is mounted within blower compartment 42 with the outlet 56 connected in linear gas flow relationship with inner tube 14. Outer tube 12 is connected in gas flow relationship with blower compartment 42, which thus forms a flow path between outer tube 12 and the inlet 54 of blower 50. It may be remarked that the forward edge 58 of containment fence 6 is angled downwardly from blower 50, so as not to restrict the passage of gases from outer tube 12 to blower inlet 54. A drive motor 60 is mounted within compartment 44 from fence 46 in operative connection with blower 50.

Intermediate the axial ends of outer tube 12 and normal thereto there is located a stub connector 62 to provide a flue gas inlet to inlet tube 12 to which connector the flue outlet F of a heating furnace H or like appliance will normally be directly connected. An air transfer tube 64 connects between drive motor compartment 44 and outer tube 12 marginally upstream of stub connector 62 to induct a small flow of ambient air through the motor compartment for cooling purposes. Normally, air transfer tube 64 will have a cross section equal to about 4 to 5% that of the effective cross section of inlet tube 12. In addition a thermometric capillary 65 locates within air transfer tube 64 to sense the temperature within tube 12 adjacent stub connector 62 marginally upstream thereof.

Power vent 10 further includes a balance sleeve or damper 66 which is slidingly mounted within outer tube 12 and remotely operable by means of a rod 68, which extends in axial alignment within outer tube 12 to within motor compartment 44, to vary the effective surface area of air intake opening 32. Rod 68 will normally be operably only by removal of housing of motor compartment 44, and will therefore not be readily accessible to non-qualified persons.

The dimensions of the various components of power vent 10 are not critical and may be varied within wide limits, although operation within certain criteria as follows will normally give preferred results:

1. The effective cross sectional area of air inlet tube 12 will be somewhat larger than that of vent tube 14. By effective area in this instance is meant the cross sectional area of outer tube 12 less that of inner tube 14. Generally speaking ratios in the range of about 115 to 120% will be preferred.

2. The area of air intake opening 32 will be greater than the effective cross sectional area of air inlet tube 12. Generally ratios in the range of about 115% to 120% will be preferred.

3. Blower 50 and motor 60 should be capable of providing air inlet flows not less than 5 times that of the volume flow of flue gas to be handled by power vent 10. Generally the ratio will be in the range of about 5 to 50 times, with 10 to 20 times being preferred.

4. The diameter of tubes 12 and 14 should be such that gas velocities within the power vent are relatively high; typically velocities in the range of about 50 to 100 feet/-second will be utilized.

5. A system comprising a combustion appliance such as a heating furnace H having a flue F connected to stub connector 62 should be capable of being adjusted by means of damper 66 whereby the pressure within the heating furnace, and preferably within flue F at the stub connector, is neutral when blower 50 is operated, with the furnace off.

Considering a heating appliance H having a thermal output of about 140,000 BTU/hour produced by burning 1 US gallon/hour of light fuel oil, this will require approximately 1,540 cu. ft. of air for complete combustion. In such heating system flue F will typically have a diameter of 6 inches, as will outer tube 12, while inner tube 14 may suitably have a diameter of 4 inches. The gas velocity in flue F will be about 2 feet/second, while the gas velocity in outer tube 14 may be about 70 feet/-second, all adjusted to normal temperature and pressure.

In a typical installation the length of tubes 12, 14 will be less than 4 feet, and stub connector 62 will locate within 1 foot of the inner end 22 of outer tube 12. Accordingly, the approximate residence time of flue gas between the stub connector 62 and the outlet of blower 50 will be very low, in the order of 0.01 to 0.02 second. Although the average temperature within blower 50 may be very low, particularly where the intake air is well below freezing temperatures, the rapid passage of the flue gas through blower 50 ensures that relatively little condensation of water vapour contained in the flue gases will take place within the blower.

In the installation of power vent 10 in a heating system it will normally be ensured that tubes 12 and 14 are downwardly pitched at a small angle towards the outer ends 18,20 thereof to provide a run-off for any condensation that occurs within the tubes, or any rain-water that adventitiously enters from outdoors. Given the high velocity of gases within power vent 10, very little condensation is in evidence under normal operating circumstances.

Due to the high velocity, full bore axial discharge of gases from orifice 38 of vent pipe 14, it is preferred to locate a convexly curved deflector 70 in their path spaced outwardly from orifice 38 by supports 72. Deflector 70 will also serve the purpose of reducing the adventitious entry of rain or snow into vent tube 14.

As earlier described, air intake opening 32 extends substantially about the periphery of outer tube 12, the purpose thereof being to permit any updraft on wall W to pass radially through outer tube 12, rather than be diverted axially along the tube into the building. It will be appreciated that while rainwater may enter intake opening 32, it may just as readily drain therefrom.In the event that intake opening 32 should become partially blocked due to freezing rain for example, the ratio of flue gas to intake air in vent tube 14 will rise and the temperature increase accordingly, so tending to melt the ice and restore full air flow through the intake opening. Under normal circumstances the temperature of the gases discharged through orifice 38 will be only some 20° C. above that of the outside air due to the low ratio of flue gas in the discharged gas.

Figure 3:
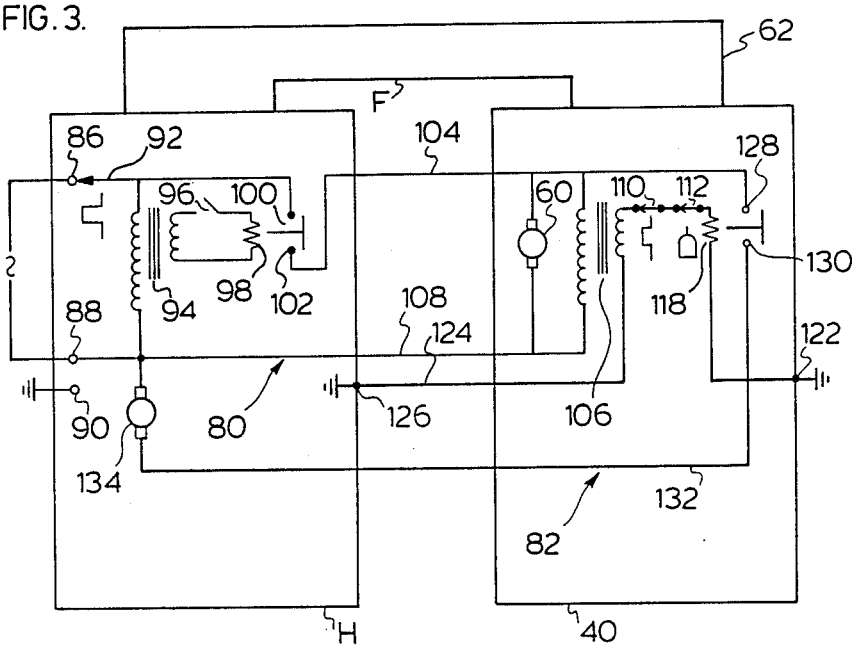
FIG. 3 shows an electrical schematic of a safety control circuit used in conjunction with the power vent.

Power vent 10 is preferably used in conjunction with a safety cut-out circuit responsive to operating conditions sensed within the power vent and the system as a whole. With particular reference to FIG. 3, a safety circuit comprises a first circuit 80 normally associated with the heating furnace H and a second circuit 82 associated with power vent 10. The first and second circuits are shown figuratively in FIG. 3 as being contained within the furnace housings and power vent housings, as flue outlet F and power vent 10 form part of the interconnecting electrical circuit; additionally, the components associated with first circuit 80 will normally be present in a heating furnace H, and where power vent 10 is retro-fitted, only those components of second circuit 82 will be additional. However, it will be appreciated that there is no necessity for the two circuits to be physically contained in either the heating furnace H or the power vent housings.

Considering the safety circuit in detail, first circuit 80 includes line and neutral terminals 86, 88 for connecting to a mains power supply and grounding wire terminal 90. A furnace high temperature limit switch 92 connects one side of the primary of a low voltage isolating transformer 94 to terminal 86, the other side of the primary connecting to terminal 88. The secondary winding of transformer 94 is connected in series with room temperature thermostat switch 96, across the coil of a relay 98. Relay 98 has normally open contacts 100, 102, the former of which is connected in series with furnace temperature limit switch 92, and the latter of which is connected via conductor 104 to the primary of an isolating transformer 106 associated with power vent 10, the other side of the primary winding connecting to neutral terminal 88 via conductor 108. Power drive motor 60 connects across conductors 104, 108 in parallel with the primary of transformer 106. One side of the secondary winding of transformer 106 serially connects through a manually resettable high temperature limit switch 110 operated by capillary sensor 65 and a pressure operated switch 112, both of which are normally closed, to one side of the coil of relay 118, the other side of this relay coil connecting at 122 to the metal housing of power vent 10, normally to housing portion 40 thereof. The other side of the secondary winding of transformer 106 connects via conductor 124 to the metal housing of heating furnace H at 126. Relay 118 has normally open contacts 128, 130, the former of which is connected to conductor 104, the latter of which is connected via conductor 134 to oil burner motor 134, in the case of an oil furnace, or to a gas solenoid in the case of a gas furnace. It may be remarked that in the case of a "standard" heating furnace safety circuit, oil burner motor 134 would connect directly to contact 102 of relay 98.

Considering the operation of the safety circuit, upon closure of thermostat switch 96, blower drive motor 60, transformer 106 and contact 128 will be energized through conductor 104. Relay 118 will close to energize contact 130, and thence oil burner motor 134, provided that flue F forms an electrically conductive path connecting furnace housing H and power vent 10. The sensing tip 65*a* of vent high temperature limit switch 110 locates within outer tube 12 adjacent stub connector 62, marginally upstream thereof and will normally open above about 300° C. Since the flue gas entering power vent 10 may have a temperature several hundred degrees higher than this, temperature limit switch 110 will quickly trip in the event that the ratio of outside air to flue gas in outer tube 12 is significantly below design limits. Such situation may arise if intake opening 32 or discharge orifice 38 is constricted, if blower 50 is non-operative, or if the volume of flue gas is in excess of design capacity for power vent 10.

Air switch 112 senses the air pressure in outer tube 12 adjacent stub connector 62 marginally upstream thereof. Conveniently, switch 112 locates within motor compartment 44 so as not to be easily accessible, and the pressure in the above noted area is transferred to switch 112 by means of sensor tube 140. In the preferred arrangement illustrated, this pressure is compared by air switch 112 to the pressure within blower compartment 44, through sensor tube 142. The pressure differential at air switch 112 is typically about 1 inch water gauge under normal operation of the heating system earlier described. In the event that discharge orifice 38 is blocked, or if either of tubes 12 or 14, or both, become perforated, the pressure differential sensed by air switch 112 will be reduced, thereby opening switch 112 and disconnecting oil burner motor 134.

It should be appreciated that in the foregoing description the arrangement of the parts is set forth somewhat schematically for the purpose of clarity, particularlity in FIG. 1. Thus blower compartment 42 will be relatively restricted in volume so as to reduce gas residence times in power vent 10 and maintain a high velocity therethrough. Also, in a preferred arrangement the axis of motor 60 and lower 50 would be horizontal, but a vertical arrangement is here illustrated in order to depict more conveniently the relationship between stub connector 62 and vent condition sensors 65*a* and 140.

It will be apparent that many changes may be made to the illustrative embodiment, while falling within the scope of the invention and it is intended that all such changes be covered by the claims appended hereto.

I claim:

1. A power vent for venting gases from a flue through the wall of a building comprising:

an inlet tube;

a vent tube generally coextensive with said inlet tube and contained therewithin;

each said tube having a first end intended to locate outside said building wall and second end axially opposed thereto;

said inlet tube having an air intake opening adjacent said first end, and a T inlet connector intermediate said first and second ends for connecting to said flue, and a blower unit having an inlet side and an outlet side respectively connected to said second end of said inlet tube and said vent tube.

2. A power vent as defined in claim 1, wherein said air intake opening is provided in the peripheral wall of said inlet tube, and said inlet tube is sealed to said vent tube axially outwardly of said intake opening.

3. A power vent as defined in claim 2, wherein said air intake opening comprises a plurality of openings together locating about a 360° radial interval.

4. A power vent as defined in claim 1, wherein said air intake opening has an area greater than the effective cross sectional area of said inlet tube.

5. A power vent as defined in claim 1, wherein said air intake opening has an area not less than 115% that of the effective area of said inlet tube.

6. A power vent as defined in claim 1, wherein said inlet tube has an effective area greater than that of said vent tube.

7. A power vent as defined in claim 1, comprising a damper located intermediate said first end of said inlet tube and said T connector for adjusting the flow of air through said inlet tube.

8. A power vent as defined in claim 7, wherein said damper is slidingly mounted coaxially within said inlet tube and is operable so as to vary the effective area of said air intake opening.

9. A power vent as defined in claim 7, wherein the maximum area of said air intake opening is greater than the effective cross sectional area of said inlet tube.

10. A power vent as defined in claim 8, wherein said damper is operatively connected to a linkage extending along said inlet tube to adjacent said blower unit for adjustment of the effective area of said air intake opening.

11. A power vent as defined in claim 1, wherein said vent tube at the first end thereof is substantially unrestricted to permit the egress of gases to the ambient in an axial direction.

12. A power vent as defined in claim 1, wherein said T connector locates adjacent said second end.

13. A power vent as defined in claim 1, further comprising a fan chamber within which said blower unit is mounted, said inlet side of said blower unit connecting to said inlet tube through said fan chamber.

14. A power vent as defined in claim 13, further comprising a drive motor for said blower unit, and a drive motor chamber generally sealed to said fan chamber.

15. A power vent as defined in claim 14, including an air transfer tube interconnecting said drive chamber and said inlet tube outwardly of said T connector for educting a flow of cooling air through said drive chamber.

16. A power vent as defined in claim 1, including switch means for generating a signal responsive to a predetermined condition in said inlet tube intermediate said T connector and said first end selected from a rise in temperature and a rise in pressure.

17. A power vent for venting gases from a flue through the wall of a building comprising an outer and inner coaxial, elongated, generally coextensive tubes having a first end for locating on the outside of said wall and a second end axially remote from said first end;

said tubes being sealed together adjacent said first end;

said outer tube having an air intake opening extending substantially about the periphery thereof adjacent said first end, said inner tube having a generally unrestricted axially open end for exhausting gases therefrom;

said outer tube having a T inlet connector in the wall thereof adjacent the second end thereof having a diameter approximately equal to the diameter of said outer tube, and a blower unit including a scroll chamber having an outlet thereto coaxially connected to said second tube, and an inlet connected in gas flow relation with said second end of said outer tube.

18. In an indoor heating system including apparatus for combusting a fuel;

a fuel supply;

a power vent and a flue connecting said combustion apparatus to said power vent, a safety control circuit including means for detecting a continuous electrical path between said combustion apparatus and said power vent and means responsive to the detection of a non-continuous path for interrupting said fuel supply to said combusting apparatus.

19. An indoor heating system as claimed in claim 18, wherein said power vent includes a first tube having axially opposed ends, one said end locating outdoors and forming an air inlet to said tube, a blower having an inlet connected the other said end, said flue connecting between said ends, and switch means responsive to at least one condition in said tube intermediate said inlet and said flue connection selected from a predetermined temperature increase and a predetermined pressure increase for interrupting said fuel supply upon detection of said at least one condition.

20. An indoor heating system as claimed in claim 19, wherein said switch means is responsive to each said condition.

21. An indoor heating system as claimed in claim 19, wherein said switch means responsive to said pressure increase is a differential pressure air switch.

22. An indoor heating system as claimed in claim 19, wherein said system includes a drive motor for said blower and a housing for said drive motor, and an air transfer tube connecting between said drive motor housing and said first tube intermediate said inlet and said flue connection for educting a small flow of cooling air through said motor housing.

23. A power vent for venting flue gases from a furnace through a adjacent wall having an outdoor side and an indoor side comprising:

an air inlet tube and a vent tube coaxially locating therewithin and generally coextensive therewith, each said tube having a first end locating on the outdoor side of said wall, said first ends respectively defining an air intake opening and a discharge orifice;

said tubes each having a second end axially opposed to said first end locating on the indoor side of said wall; and a blower having an inlet connected to said air inlet tube and an outlet connected to said vent tube, said air inlet tube having a T connector in the wall thereof for connecting the flue of said furnace thereto.

24. An apparatus for exhausting combustion gases produced in a furnace at a predetermined rate through a wall of a building having an outdoor side and an indoor side which includes an air inlet tube and an air outlet tube each having a first end for location on the outdoor side of said wall and a second end for locating on the indoor side of said wall and a blower for inducing a flow of air through said tube, characterized wherein said blower interconnects said second ends to form with said tubes an air flow loop independent of said furnace for inducing a volumetric flow rate of air through said loop at least five times that of the volumetric flow rate of said combustion gases, and wherein said air inlet tube is provided with a T junction intermediate the axial ends thereof for connecting the flue of said furnace thereto.

25. Apparatus as defined in claim 24, wherein said volumetric flow rate of air and combustion gases is within the ratio of about 5:1 to about 50:1.

26. Apparatus as defined in claim 25, wherein said ratio is within the range of about 10:1 to about 20:1.

27. Method of exhausting combustion gases from the flue of a furnace through a wall of a building having an outdoor side and an indoor side comprising providing an air inlet tube and an air outlet tube each having a first end locating on the outdoor side of said wall respectively for the intake and discharge of air therethrough;

said tubes each having a second end located on said indoor side of said wall;

interconnecting said second ends through a blower to form an air flow loop therewith independent of said furnace;

operating said blower to pass air through said loop at a volume flow rate not less than five times that of said combustion gases; and connecting said flue into said air inlet tube intermediate the ends thereof.

28. Method as defined in claim 27, wherein said air is passed through said loop at a volume flow of from about 10 to about 20 times that of said combustion gases.

* * * * *